US009272521B2

(12) United States Patent
Aoki

(10) Patent No.: US 9,272,521 B2
(45) Date of Patent: Mar. 1, 2016

(54) LIQUID HOUSING CONTAINER RECYCLING METHOD, AND LIQUID HOUSING CONTAINER

(71) Applicant: SEIKO EPSON CORPORATION, Tokyo (JP)

(72) Inventor: Yuji Aoki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/495,081

(22) Filed: Sep. 24, 2014

(65) Prior Publication Data

US 2015/0085035 A1 Mar. 26, 2015

(30) Foreign Application Priority Data

Sep. 26, 2013 (JP) ..... 2013-199383

(51) Int. Cl.
*B41J 2/175* (2006.01)

(52) U.S. Cl.
CPC ..... *B41J 2/17563* (2013.01); *B41J 2/1752* (2013.01); *B41J 2/1753* (2013.01); *B41J 2/17513* (2013.01); *B41J 2/17523* (2013.01); *B41J 2/17553* (2013.01)

(58) Field of Classification Search
CPC . B41J 2/17506; B41J 2/17503; B41J 2/17563
USPC ..... 347/86, 93
See application file for complete search history.

(56) References Cited

U.S. PATENT DOCUMENTS

| | | | | |
|---|---|---|---|---|
| 5,621,445 | A * | 4/1997 | Fong et al. | 347/87 |
| 6,520,630 | B1 * | 2/2003 | Oda et al. | 347/85 |
| 6,969,161 | B2 * | 11/2005 | Kuwabara et al. | 347/85 |
| 7,008,050 | B2 * | 3/2006 | Childers et al. | 347/85 |
| 7,431,443 | B2 * | 10/2008 | Silverbrook et al. | 347/87 |
| 8,177,342 | B2 * | 5/2012 | Wanibe et al. | 347/86 |
| 2003/0038866 | A1 * | 2/2003 | Yu et al. | 347/86 |
| 2006/0227190 | A1 * | 10/2006 | Ishizawa et al. | 347/86 |
| 2007/0252877 | A1 * | 11/2007 | Okubo | B41J 2/17509 347/93 |

FOREIGN PATENT DOCUMENTS

| | | | |
|---|---|---|---|
| JP | 2004-358802 | A | 12/2004 |
| JP | 2011-148221 | A | 8/2011 |

* cited by examiner

*Primary Examiner* — Matthew Luu
*Assistant Examiner* — Patrick King
(74) *Attorney, Agent, or Firm* — Global IP Counselors, LLP

(57) ABSTRACT

A liquid housing container recycling method is provided for a liquid housing container with a liquid housing body that includes a liquid housing unit that is configured to house liquid, a supply member with a supply port that is configured to be connected to a liquid supply tube of a liquid consuming device, and a filter through which the liquid is configured to pass, with the liquid inside the liquid housing unit being supplied to the liquid consuming device by, after passing through the filter, flowing to the supply port along a supply flow path of the supply member. The liquid housing container recycling method includes forming a detour flow path in the liquid housing body such that the liquid inside the liquid housing unit flows to the supply port without passing through the filter in the detour flow path, and injecting the liquid inside the liquid housing unit.

4 Claims, 9 Drawing Sheets

LIQUID HOUSING CONTAINER RECYCLING METHOD, AND LIQUID HOUSING CONTAINER

CROSS-REFERENCE TO RELATED APPLICATIONS

This application claims priority to Japanese Patent Application No. 2013-199383 filed on Sep. 26, 2013. The entire disclosure of Japanese Patent Application No. 2013-199383 is hereby incorporated herein by reference.

BACKGROUND

1. Technical Field

The present invention relates to a liquid housing container recycling method for a liquid housing container capable of housing liquid, and to a liquid housing container.

2. Related Art

From the past, inkjet printers have been known as an example of a liquid consuming device that sprays and consumes a liquid (ink or the like). A liquid housing container (ink cartridge or the like) with a liquid housing body (ink pack or the like) having a liquid housing unit in which liquid is housed equipped inside a case member is mounted in this kind of printer, and liquid is supplied from the liquid housing container mounted in this way.

A supply port that flows out the liquid housed in the liquid housing unit is provided on a liquid housing body of this kind of liquid housing container. In a state with the liquid housing body housed inside the liquid housing container, this supply port is exposed inside the case member. Then, when the liquid housing container is mounted in a mounting unit of the printer, this supply port is connected to be able to supply liquid to a liquid supply tube (e.g., a supply needle) provided in the printer. Alternatively, there are also cases when the liquid is supplied to the liquid supply tube from the supply port by connecting the supply port and the liquid supply tube with a tube that is a liquid flow path.

Also known are liquid housing containers for which arranged inside the liquid housing unit is a filter that removes foreign matter from within the liquid flowed out from the supply port by the liquid passing through the inside of the liquid housing unit (see JP-A-2011-148221 (Patent Document 1), for example).

Furthermore, there have been proposals to recycle liquid housing containers for which supplying of liquid to the printer has become difficult due to the liquid inside the housing unit decreasing with supplying of liquid to the printer, by again injecting liquid inside the liquid housing unit of the liquid housing body housed inside that liquid housing container (see JP-A-2004-358802 (Patent Document 2), for example).

SUMMARY

However, with the liquid housing container equipped with the liquid housing body having a filter arranged inside the liquid housing unit, by which foreign matter is removed when the liquid inside the liquid housing unit passes through the filter and is deposited on the filter, due to the deposited foreign matter, it is possible for the volume of liquid that passes through the filter to be suppressed. In that case, with the liquid housing container recycled by again injecting liquid, there is the problem that the liquid inside the liquid housing unit is no longer supplied smoothly to the printer due to suppression of the liquid volume when passing through the filter and flowing to the supply port.

This circumstance is not limited to the liquid housing container mounted on the mounting unit of the printer, but is also generally common to a liquid housing container equipped with a liquid housing body for which a filter is arranged inside the liquid housing unit which is capable of housing liquid.

The present invention is conceived in light of these circumstances, and an advantage is to provide a liquid housing container recycling method for recycling to make it possible for liquid to flow smoothly to the supply port from the liquid housing unit, and a liquid housing container.

Following, we will note the means for solving the problems noted above, and the effects thereof.

The liquid housing container recycling method to address the problems noted above is a liquid housing container recycling method for a liquid housing container with a liquid housing body that includes a liquid housing unit that is configured to house liquid, a supply member with a supply port that is configured to be connected to a liquid supply tube of a liquid consuming device, and a filter through which the liquid is configured to pass, with the liquid inside the liquid housing unit being supplied to the liquid consuming device by, after passing through the filter, flowing to the supply port along a supply flow path of the supply member. The liquid housing container recycling method includes a detour flow path forming step of forming a detour flow path in the liquid housing body such that the liquid inside the liquid housing unit flows to the supply port without passing through the filter in the detour flow path, and an injection step of injecting the liquid inside the liquid housing unit.

With this method, even in a state with the filter clogged by foreign matter, the liquid housing container can be recycled so as to be able to smoothly flow liquid to the supply port from the liquid housing unit via the detour flow path.

With the liquid housing container recycling method noted above, it is preferable that the detour flow path is a through hole that is formed in the supply member and pierces between the supply port and inside the liquid housing unit.

With this method, the detour flow path is formed by providing the through hole in the supply member, so it is possible to easily form the detour flow path for which the liquid inside the liquid housing unit flows to the supply port.

With the liquid housing container recycling method noted above, it is preferable that the supply port is provided at a flow path end of a tube shaped flow path part with a straight line forming a portion of the supply flow path as an axis line, the filter is arranged at a position that does not overlap the supply port as viewed from the axis line direction of the tube shaped flow path part, and the through hole formed on the supply member is a hole extending from the supply port in a straight line along the axis line direction of the tube shaped flow path.

With this method, it is possible to form the detour flow path while suppressing damage to the filter using an easy method of forming the through hole in linear form from the supply port to the direction along the tube shaped flow path part.

With the liquid housing container recycling method noted above, it is preferable that with the injection step, the injecting of the liquid includes injecting the liquid from the supply port to the liquid housing unit via the detour flow path that has been formed in the detour flow path forming step.

With this method, it is possible to smoothly flow and inject liquid inside the liquid housing unit from the supply port using the detour flow path that does not go via the filter without separately forming an injection port in the liquid housing unit.

The liquid housing container for solving the problems noted above is recycled by the liquid housing container recycling method noted above.

With this liquid housing container of this constitution, the same effects are exhibited as the effects with the liquid housing container recycling method of the liquid housing container noted above.

The liquid housing container for solving the problems noted above is a liquid housing container equipped with a liquid housing body including a liquid housing unit that is configured to house liquid, a supply member with a supply port that is configured to be connected to a liquid supply tube of a liquid consuming device, and a filter through which the liquid is configured to pass, with the liquid inside the liquid housing unit passing through the filter to supply the liquid to the liquid consuming device, the liquid housing body defining a supply flow path in which the liquid inside the liquid housing unit flows to the supply port after passing through the filter, and a detour flow path in which the liquid inside the liquid housing unit flows to the supply port without passing through the filter.

With this constitution, it is possible to recycle the liquid housing container so that not only is the injection of liquid easy, but even in a state with the filter clogged by foreign matter, it is possible for the liquid to flow smoothly from the liquid housing unit to the supply port via the detour flow path.

BRIEF DESCRIPTION OF THE DRAWINGS

Referring now to the attached drawings which form a part of this original disclosure:

FIGS. 4A and 4B are perspective views seen in a state with the ink pack flipped over;

FIG. 5A is an arrow cross section view of line 5*a*-5*a* in FIG. 4A, and FIG. 5B is an arrow cross section view of line 5*b*-5*b* in FIG. 4B;

FIG. 9A is a plan view showing a detour flow path different from the through hole, and FIG. 9B is an arrow cross section view of line 9*b*-9*b* in FIG. 9A.

DETAILED DESCRIPTION OF EMBODIMENTS

Figure 1:
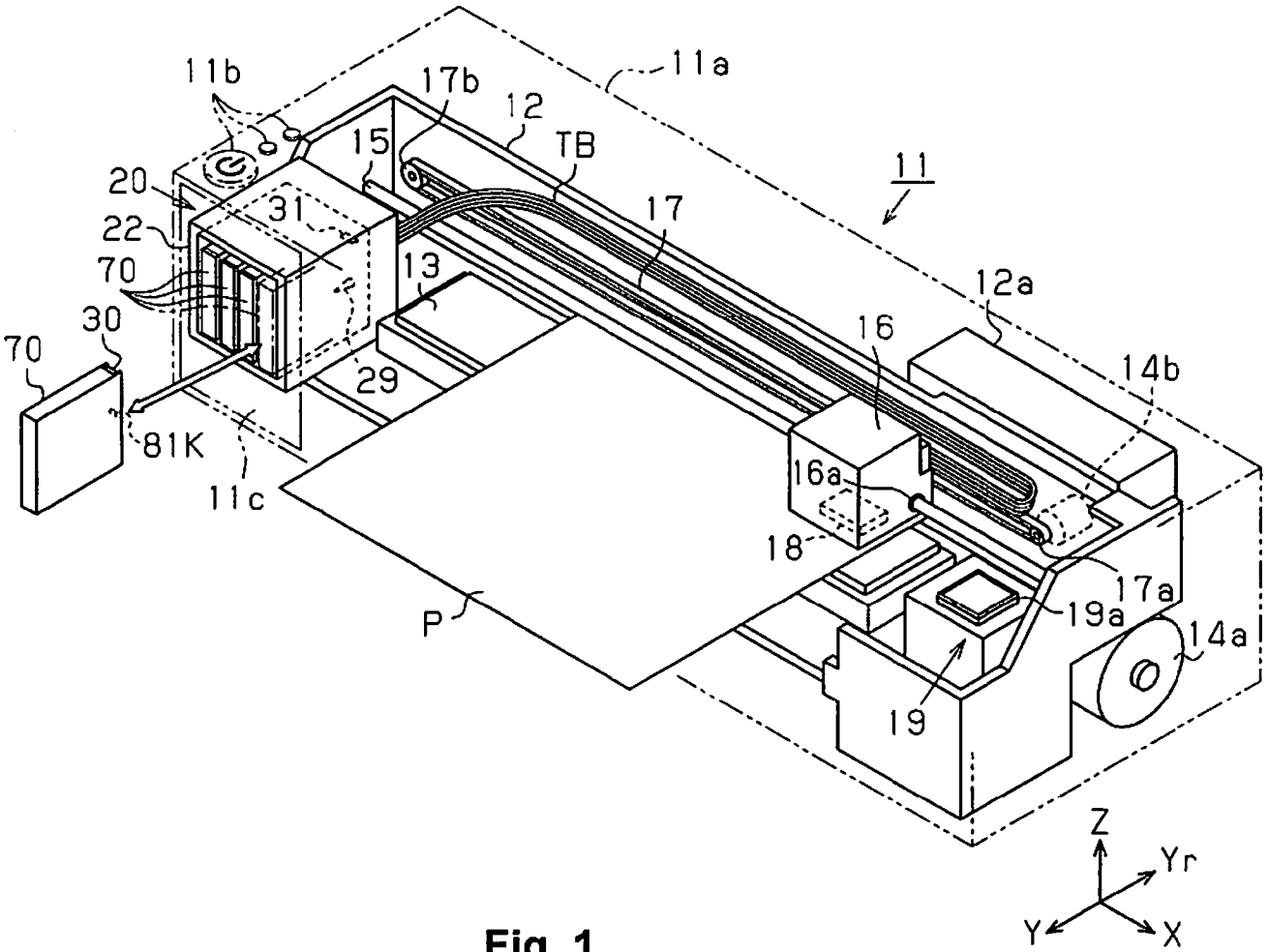
FIG. 1 is a schematic perspective view showing an embodiment of a printer which is an example of a liquid consuming device.

Hereafter, we will describe an embodiment of an inkjet printer which is an example of a liquid consuming device while referring to the drawings. The printer of this embodiment performs printing on a paper P by spraying, specifically, consuming, ink which in an example of a liquid on a paper P conveyed in one direction to form an image.

As shown in FIG. 1, the printer 11 of this embodiment is equipped with a case 11*a* having a roughly rectangular solid shape, a portion of which is shown by a double dot-dash line, and on the top surface of the antigravity direction Z side in the vertical direction, provided is an operating button 11*b* such as a power button or the like for driving the printer 11, and a display unit (not illustrated). Also, an open and closeable cover 11*c* is provided on the front surface of the case 11*a* which is the conveyance direction Y side in which the paper P is conveyed. In a state with this cover 11*c* open, it is possible for the user to attach and detach and replace an ink cartridge 70.

At the bottom part that becomes the gravity direction side inside a frame 12 forming a roughly rectangular box shape housed in an internal space covered by this case 11*a*, a support base 13 which has the direction orthogonal to the paper P conveyance direction Y as the lengthwise direction is provided extending in roughly the horizontal direction, and a paper feed motor 14*a* is provided on the bottom part of the rear side which is the side opposite to the conveyance direction Y. Specifically, through driving of this paper feed motor 14*a*, using a paper feed mechanism (not illustrated), the paper P is fed facing from that rear side to the front side on the support base 13.

Also, upward, which becomes the antigravity direction side of the support base 13 inside the frame 12, a guide shaft 15 is stretched across along the lengthwise direction of the support base 13. A carriage 16 is supported so as to be able to move back and forth in the axis line direction on this guide shaft 15. More specifically, a support hole 16*a* that pierces through in the lateral direction is formed on the carriage 16, and the guide shaft 15 is inserted through this support hole 16*a*.

A driving pulley 17*a* and a driven pulley 17*b* are respectively supported to be able to rotate freely at positions near both ends of the guide shaft 15 noted above on the back wall inner surface of the frame 12. An output shaft of a carriage motor 14*b* is coupled to the driving pulley 17*a*, and a seamless timing belt 17 for which a portion is coupled to the carriage 16 is wound between the driving pulley 17*a* and the driven pulley 17*b*. Also, by the carriage motor 14*b* being driven, while the carriage 16 is guided by the guide shaft 15 via the timing belt 17, it moves back and forth in the lengthwise direction, specifically, along the scanning direction X. A liquid spray head 18 which is an example of a liquid spray unit is provided on the bottom side of this carriage 16, and the ink supplied to this liquid spray head 18 is sprayed from the liquid spray head 18 and consumed, and an image is printed on the paper P.

Inside the case 11*a*, at the left side of the scanning direction X seen from the front side, arranged is a mounting unit 20 for which an ink cartridge 70 which is an example of a liquid housing container is mounted so as to be able to be inserted and removed. An ink supply tube TB capable of flowing ink is coupled between the mounting unit 20 and the carriage 16. The ink inside the ink cartridge 70 is supplied to the liquid spray head 18 via this ink supply tube 113.

With this embodiment, the mounting unit 20 has a box shaped cartridge holding body 22 for which the front side is opened. Four roughly rectangular solid ink cartridges 70 are constituted to be able to be mounted aligned along the scanning direction X inside the cartridge holding body 22. Housed in the four ink cartridges 70, for example, are mutually different colors of cyan, magenta, yellow, and black ink. Because of this, on each mounting unit 20 are also equipped four supply needles 29 corresponding to each ink cartridge 70 which are examples of a liquid supply tube. Each ink cartridge 70 can be inserted and removed as shown by the white outline arrow in the mounting unit 20 inside the case 11*a* in a state with the cover 11*c* opened.

Also, by the supply needle 29 being provided in the inner wall of the cartridge holding body 22 of the Yr tip side of the insertion direction of the ink cartridge 70, and the supply port 81K of the inserted ink cartridge 70 and the supply needle 29 being connected, ink is supplied from the ink cartridge 70. Also, the ink supplied to the supply needle 29 is sent to the liquid spray head 18 via the ink supply tube TB from the ink flow path formed on the mounting unit 20 by the operation of a pump (not illustrated) (e.g., a diaphragm pump) equipped in the mounting unit 20. With this embodiment, the insertion direction Yr of the ink cartridge 70 is the opposite direction to the conveyance direction Y of the paper P.

Meanwhile, in the area further to the scanning direction X right side seen from the front side than the support base 13 in the frame 12 interior, specifically, the home position area that is not used during printing, provided is a maintenance device 19 having a box shaped cap with a bottom 19*a* that is opened upward and a suction pump or the like (not illustrated). Also, with the printer 11, after the carriage 16 is moved to the home position area, with this maintenance device 19, a maintenance operation is performed that does maintenance so that ink is sprayed stably from the liquid spray head 18.

The various operations performed by this kind of printer 11 are controlled by a control unit. With this embodiment, the control unit is constituted by a circuit substrate on which are mounted electrical components such as a CPU, RAM, ROM or the like, and for example is arranged inside a case 12*a* equipped to the rear of the frame 12.

Furthermore, when ink is supplied from the ink cartridge 70, the control unit performs communication of designated cartridge information (e.g., data such as ink cartridge 70 identification data or the remaining volume of ink inside the ink cartridge 70 or the like) with memory (not illustrated) which is an example of a storage device equipped in the ink cartridge 70. The cartridge information is updated as appropriate by the control unit. Also, the ink remaining volume data is displayed on a display unit of the case 11*a* as necessary.

This liquid information communication is specifically performed by an electrical connection between an electrical connection part 31 constituted by terminals or the like equipped in the cartridge holding body 22, and an electrical connection part 30 constituted by a circuit substrate having terminals equipped in the ink cartridge 70. Therefore, four electrical connection parts 31 are equipped according to the number of ink cartridges 70 in the mounting unit 20. In FIG. 1, only one electrical connection part 31 is illustrated.

Figure 2:
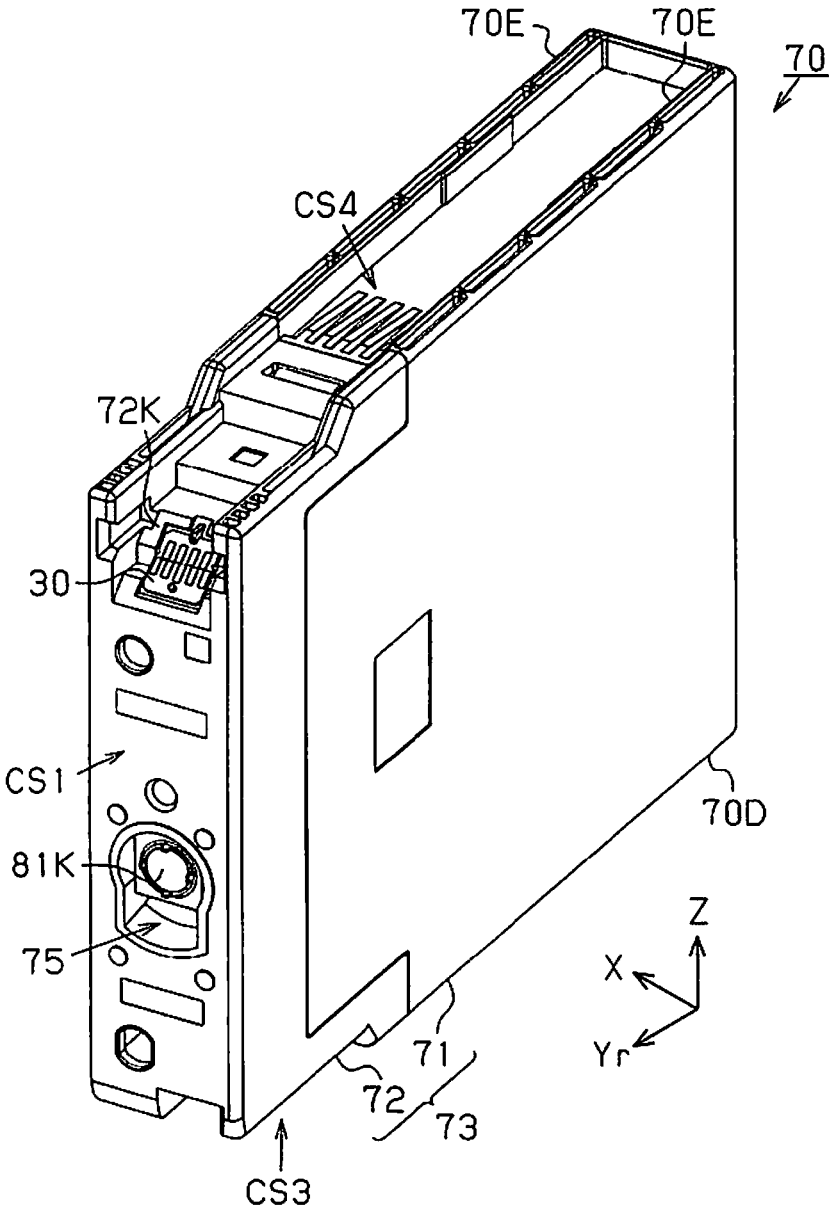
FIG. 2 is a perspective view showing an ink cartridge mounted in a mounting unit of the printer.

As shown in FIG. 2, the ink cartridge 70 of this embodiment has a first case member 71 on the rear side opposite to the lead side of the insertion direction Yr, and a second case member 72 on the lead side of the insertion direction Yr. Also, the supply port 81K of the ink pack 80 is exposed on the concave shaped part 75 provided on the front side surface CS1 of the lead side, specifically, the front side surface CS1 of the second case member 72 during insertion of the ink cartridge 70. Also, an inclined plane 72K is provided on the top end part of the front side surface CS1 on the second case member 72, and the electrical connection part 30 is attached to this inclined plane 72K.

With this embodiment, with the mounting unit 20, a guide rib (not illustrated) is provided at a position corresponding to the inserted ink cartridge 70, and the ink cartridge 70 is inserted while being guided by the guide rib of the mounting unit 20. Specifically, on the bottom side surface CS3 and the top side surface CS4 of the ink cartridge 70, respectively formed are a lower convex part 70D and an upper convex part 70E that extend along the insertion direction Yr at both end parts in the width direction. By this upper convex part 70E and lower convex part 70D being moved while being aligned by respectively abutting the guide ribs provided on the mounting unit 20 in the scanning direction X, the ink cartridges 70 are inserted in set positions with the mounting unit 20. As a result, the supply port 81K is suppressed from having positional skew in relation to the supply needle 29, and is made to be suitably connected to the supply needle 29. Also, the electrical connection part 30 is suppressed from having positional skew in relation to the electrical connection part 31, and is made to be suitably connected to the electrical connection part 31.

Next, we will describe the internal constitution of the ink cartridge 70.

Figure 3:
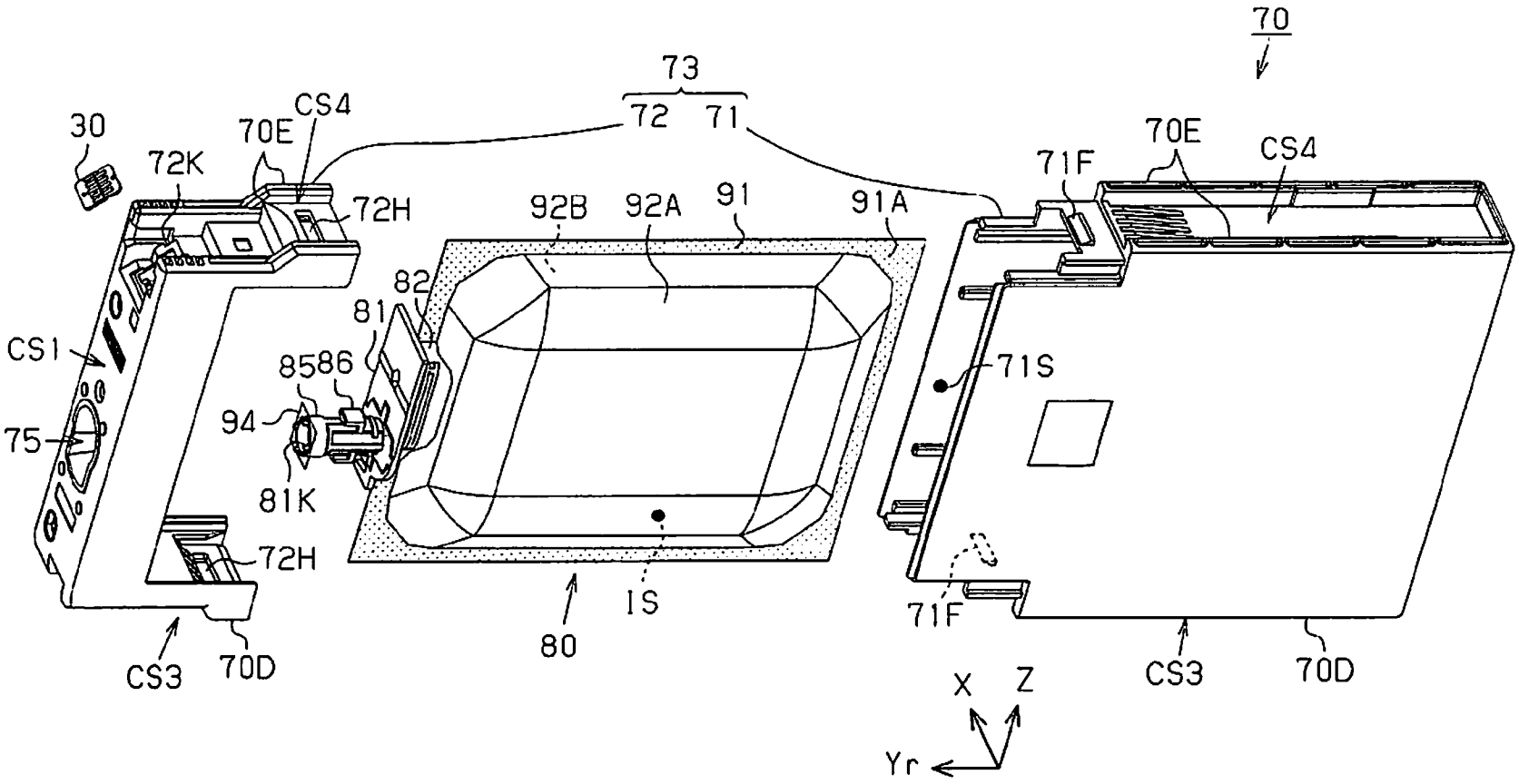
FIG. 3 is an exploded perspective view showing the constitution of the ink cartridge.

As shown in FIG. 3, the ink cartridge 70 has the ink pack 80 as the liquid housing body housed inside the case member 73 for which the two members of the first case member 71 and the second case member 72 are combined. The X, Yr, and Z directions shown in FIG. 3 are the same as the X, Yr, and Z directions of FIG. 1 with the orientation of the ink cartridge 70 mounted in the printer 11.

The first case member 71 has roughly a box shape having an opening area 71S in which the ink pack 80 can be inserted and removed, and roughly triangular prism shaped projecting parts 71F are respectively formed on the bottom side surface CS3 and the top side surface CS4. Meanwhile, on the second case member 72, roughly rectangular hole parts 72H in which the projecting part 71F can be inserted are respectively formed on the bottom side surface CS3 and top side surface CS4. Also, as the second case member 72 is moved so as to cover that opening area 71S on that first case member 71, by the projecting part 71F of the first case member 71 being fit from the inside in the hole part 72H of the second case member 72, the second case member 72 is attached to the first case member 71. Conversely, by pulling the second case member 72 so as to pull away from the first case member 71, the projecting part 71F is taken out from the hole part 72H, and the second case member 72 is removed from the first case member 71.

The ink pack 80 has the opening side of a bag shaped pack body 91 which is an example of the liquid housing unit joined to a junction part 82 of the supply member 81 which has the supply port 81K. Its interior is an ink chamber IS (liquid housing unit) in which ink can be housed. With this embodiment, the pack body 91 is formed using a flexible sheet member, and two sheet form pack members 92A and 92B are first formed into a bag shape with three of the four outer edges adhered. Next, in a state with the junction part 82 of the supply member 81 inserted in the bag opening side formed by the one side that is not adhered, by adhering at one side together with the supply member 81, an adhered part 91A is formed around the periphery of the pack body 91 shown by the shaded area in FIG. 3, and the interior of the pack body 91 is used as the ink chamber IS. Then, the flexible pack body 91 is deformed so as to decrease the gap between the two pack members 92A and 92B facing opposite as the capacity of the ink chamber IS decreased due to an outflow of ink.

With this embodiment, the constitution is such that the supply member 81 having the supply port 81K, specifically, the supply member 81 in which the supply port 81K is provided, is attached to the second case member 72 by rotating relative to the second case member 72. The supply member 81 has a tube shaped flow path part 85 provided that is in communication with the supply port 81K. A pair of parts to be engaged 86 project from the tube shaped flow path part 85. Also, the constitution is such that after the tube shaped flow path part 85 is inserted into a hole (not illustrated) provided in the concave shaped part 75 of the second case member 72, by rotating with its axis line as the center, this is fixed by the part to be engaged 86 provided in the tube shaped flow path part 85 and the concave shaped part 75 as the engaging part provided in the second case member 72 being engaged. By the tube shaped flow path part 85 being fixed to the concave shaped part 75 in this way, the ink pack 80 is attached to the second case member 72.

Next, we will describe the member constitution of the ink pack 80.

Figure 4B:
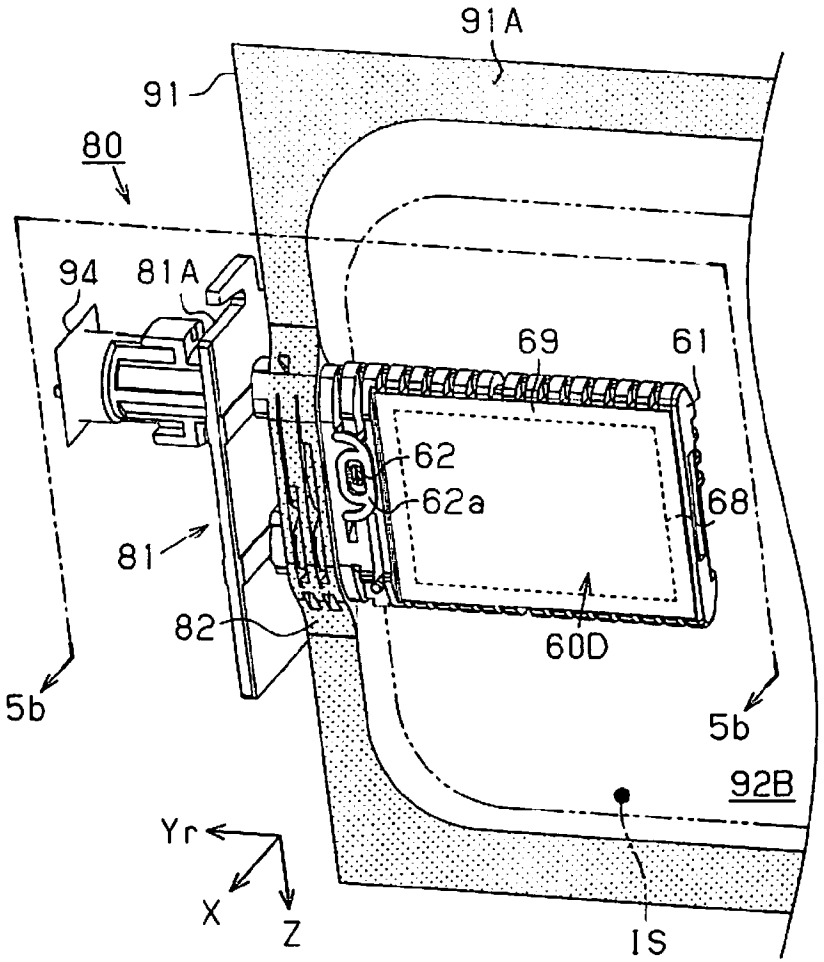
FIGS. 4A and 4B are drawings showing an ink pack equipped inside the ink cartridge, where
Figure 4A:
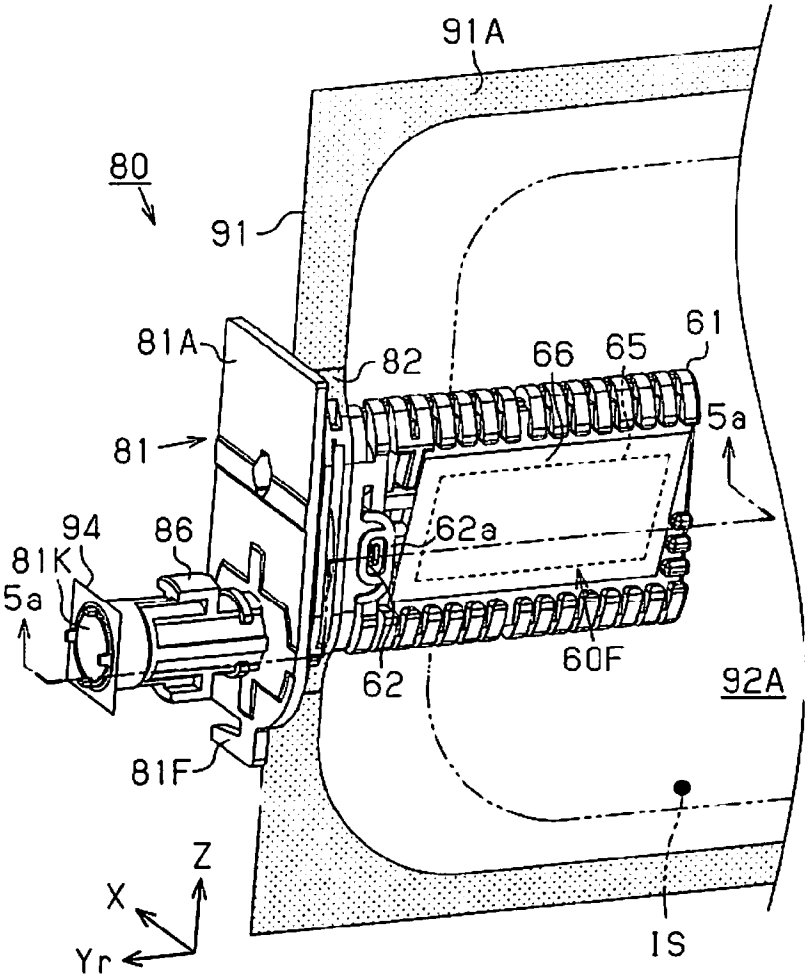

As shown in FIGS. 4A and 4B, the ink pack 80 is equipped with the supply member 81 in which the supply port 81K is provided, and a filter chamber 60F and a de-aerating chamber 60D inside the ink chamber IS inside the pack body 91 joined to the junction part 82 of this supply member 81. The X, Yr, and Z axis directions of FIGS. 4A and 4B are the same as the X, Yr, and Z axes of FIG. 1 in the orientation with the ink cartridge 70 mounted on the printer. Also, FIG. 4B shows the ink pack 80 of FIG. 4A in an inverted state. Also, with FIGS. 4A and 4B, the pack body 91 is shown in a transparent state.

With this embodiment, two spaces for which one end is respectively opened are formed on a connecting member 61 connected to the supply member 81. Also, so as to close a first opening 65 and a second opening 68 which become the openings of the respective spaces, a filter 66 through which ink can pass and a film 69 through which gas can be transmitted are respectively adhered, and a filter 60F and a de-aerating chamber 60D are formed. The filter 66 and the film 69 are arranged at mutually overlapping positions seen from the width direction of the ink cartridge 70 which is the scanning direction X in a state with the ink cartridge 70 mounted on the mounting unit 20, in other words, at positions for which they have a front and back relationship to each other with the connecting member 61.

An injection port 62 for when first injecting ink into the ink chamber IS is provided on the connecting member 61, and after ink is injected, the injection port 62 is sealed so as to block communication with the ink chamber IS by joining (adhering) pack members 92A and 92B on a ring shaped rib 62*a* provided so as to enclose this injection port 62. Also, the pack member 92A is positioned at the side facing the filter 66, and the pack member 92B is positioned at the side facing the film 69.

Figure 5A:
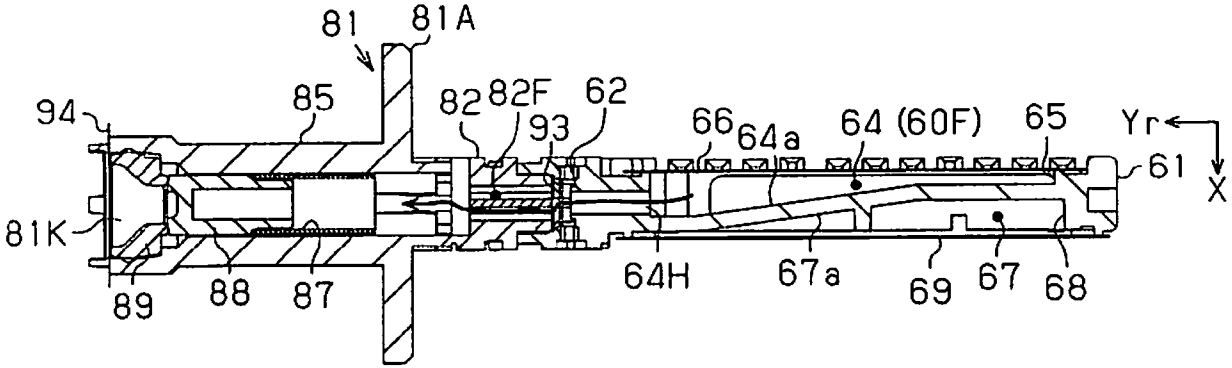
FIGS. 5A and 5B are drawings showing an ink supply flow path provided in the supply member, where
Figure 5B:
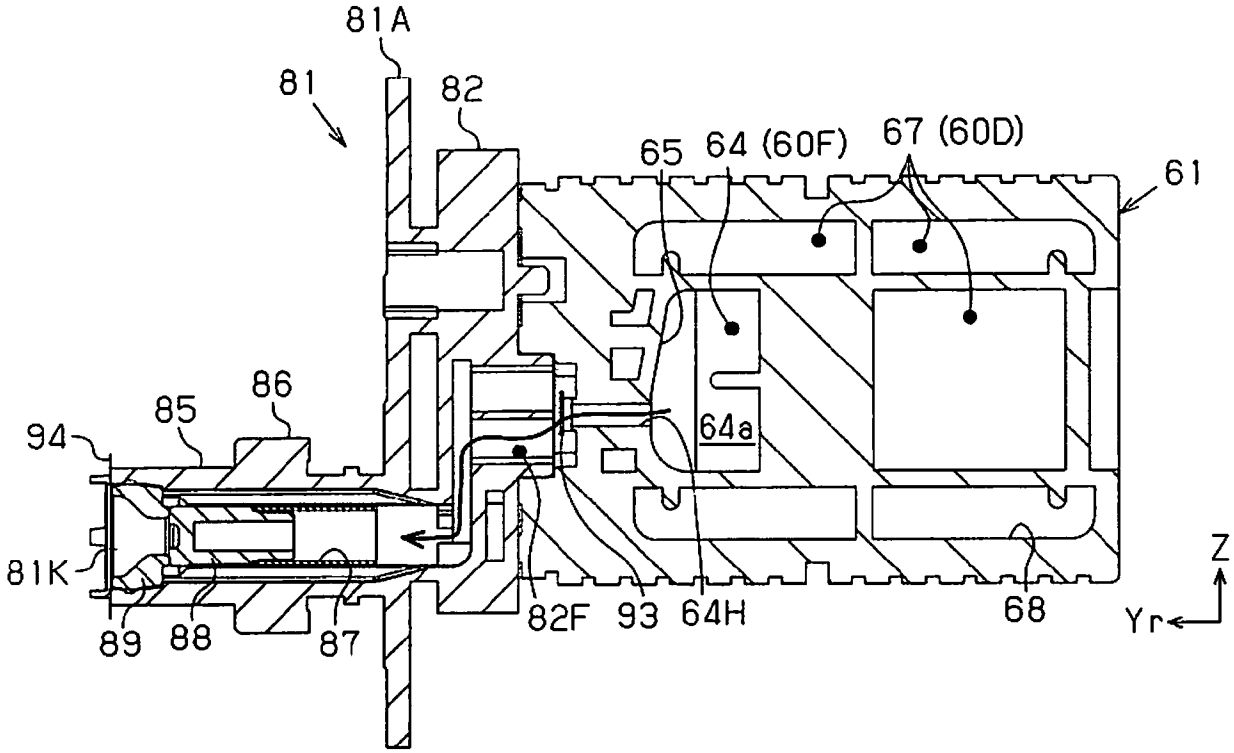

Next, we will describe the supply member 81 and the connecting member 61 while referring to FIGS. 4A and 4B and FIGS. 5A and 5B. With FIGS. 5A and 5B, the pack body 91 is omitted, and the supply member 81 and the connecting member 61 are illustrated. Also, the X, Yr, and Z axis directions of FIGS. 5A and 5B are the same as the X, Yr, and Z axes of FIG. 1 in an orientation with the ink cartridge 70 mounted in the printer.

As shown in FIGS. 5A and 5B, the connecting member 61 of this embodiment is attached to the supply member 81 by adhering or fitting while sandwiching a valve body 93 (non-return valve), and becomes an integral unit with the supply member 81. Also, the part adjacent to the connecting member 61 of the supply member 81 is the junction part 82 for which the pack body 91 is joined by adhesion or the like as shown in FIG. 4B. The connecting member 61 has an outline that is roughly a rectangular solid shape.

Also, as shown in FIG. 4A, the supply member 81 has a main unit 81A that is roughly a rectangular plate shape on the insertion direction Yr side to the mounting unit 20 with this junction part 82. One end of the lengthwise direction of the main unit 81A is rectangular whereas the other end has a roughly L shaped L part 81F formed. The tube shaped flow path part 85 is provided projecting at a position toward the edge of the L part 81F of the main unit 81A on the main unit 81A of the supply member 81.

A first recess area 64 having a first opening 65 that is roughly parallelogram shaped is provided on the connecting member 61. Also, so as to close the first opening 65 of this first recess area 64, by the filter 66 for suppressing passing through (transmission) of foreign matter other than ink so as to allow passing through of ink by transmitting it being adhered to the connecting member 61, the filter chamber 60F is formed.

Also, an inclined plane 64*a* with the tip downward facing the supply member 81 side is formed on the bottom surface of the first recess area 64 in the filter chamber 60F. Also, an ink outflow port 6411 for flowing out ink that has passed through the filter 66 to the supply member 81 from the connecting member 61 is provided on the supply member 81 side of the first recess area 64. Therefore, the ink housed in the ink chamber IS is flowed into the filter chamber 60F after passing through the filter 66, and is further flowed via the ink outflow port 64H to the supply port 81K positioned at the tip of the tube shaped flow path part 85 provided on the supply member 81.

Specifically, as shown by the solid line arrow in FIGS. 5A and 5B, the ink that flows into the filter chamber 60F after passing through the filter 66 from the ink chamber IS, after flowing into the ink outflow port 64H, passes through the valve body 93 and flows in the supply flow path 82F provided in the supply member 81, and flows inside the tube shaped flow path part 85 in communication with this supply flow path 82F. In this way, the ink inside the ink chamber IS is led up to the supply port 81K via the supply flow path 82F formed on the supply member 81 after passing through the filter 66. The valve body 93 allows the flow of ink from the ink chamber IS side to the supply port 81K side, and functions as a non-return valve restricting backflow of ink from the supply port 81K side to the ink chamber IS side.

On the tube shaped flow path part 85, as shown in FIGS. 5A and 5B, in sequence from the supply port 81K side, a supply port spring 87, a supply port spring seat 88, and a supply port sealing rubber 89 are inserted, and finally, the supply port film 94 is joined by adhesion or the like to the tip of the tube shaped flow path part 85. By this joining of the supply port film 94, the supply port 81K is in a sealed state. Then, the supply port film 94 seal is broken by the supply needle 29 being inserted in the supply port 81K formed at the tip of the tube shaped flow path part 85, and the supply port spring seat 88 that was abutting the supply port sealing rubber 89 and blocking the ink flow path is pushed in so as to separate from the supply port sealing rubber 89. As a result, at the supply port 81K, a gap is formed for which ink can flow by inserting the supply needle 29, and ink flows into the supply needle 29 that was inserted from the formed gap.

Also, with this embodiment, the first recess area 64 that becomes the filter chamber 60F and the filter 66 are arranged in overlapping positions with the supply port 81K seen from the axis line direction of the tube shaped flow path part 85 on the connecting member 61.

Furthermore, with this embodiment, on the connecting member 61, a second recess area 67 having the roughly rectangular second opening 68 on the side opposite the first opening 65 is provided so as to overlap the first recess area 64. On this second recess area 67, an inclined plane 67*a* with the tip upward approaching the second opening 68 facing the supply member 81 side is provided at a position almost overlapping the inclined plane 64*a* of the first recess area 64. Also, the film 69 through which gas that was dissolved in the ink or air bubbles generated in the ink can pass is adhered to the connecting member 61 so as to close the second opening 68 in a reduced pressure atmosphere, and the second recess area 67 is a sealed space having lower pressure than atmospheric pressure. In this way, the second recess area 67 constitutes the de-aerating chamber 60D.

Figure 6:
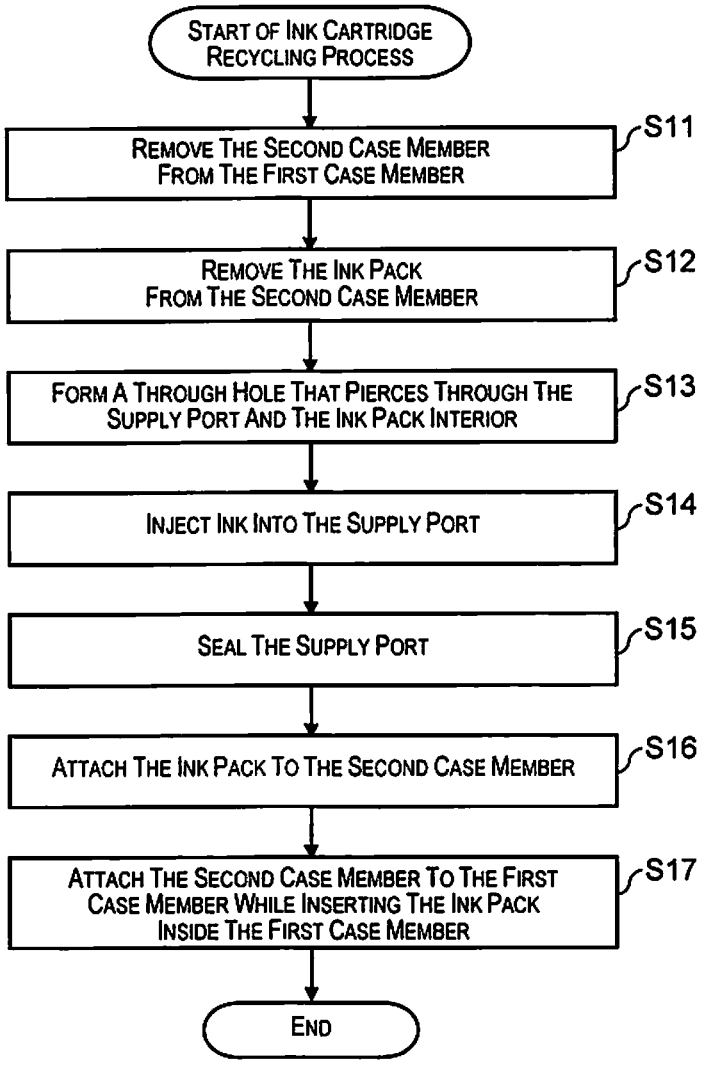
FIG. 6 is a flow chart showing the ink cartridge recycling processing method.

Next, while referring to FIG. 6, we will describe the action of recycling by re-injecting ink into the ink cartridge 70 of this embodiment, specifically, the ink cartridge 70 recycling process. This process is performed on ink cartridges 70 determined to have run out of ink based on the cartridge information of the ink cartridge 70. For example, it may be performed by the collector who collected the ink cartridge 70 that ran out of ink. The collector can also be the printer manufacturer.

As shown in FIG. 6, with this process of recycling ink cartridges, first, at step S11, the process of removing the second case member 72 from the first case member 71 is performed. The collector pulls out the second case member 72 of the ink cartridge 70 subject to recycling and removes it from the first case member 71. At this time, with this embodiment, the ink pack 80 is attached to the second case member 72, so as the second case member 72 is being pulled out, it is being taken out from the opening area 71S of the first case member 71.

Next, at step S12, the process of removing the ink pack from the second case member 72 is performed. In specific terms, the engagement of the part to be engaged 86 formed on the tube shaped flow path part 85 of the ink pack 80 and the concave shaped part 75 is released by rotating the ink pack 80 in relation to the second case member 72, for example, and the ink pack 80 is removed from the second case member 72.

Next, at step S13, the process of forming the through hole KH that pierces through the supply port 81K and the inside of the ink pack 80 is performed (detour flow path forming step). Here, a round cross section hole is opened in the supply member 81 in linear form along the axis line direction of the tube shaped flow path part 85 from the supply port 81K. With this embodiment, with this process, formation of the through hole KH is performed with the supply port spring 87, the supply port spring seat 88, and the supply port sealing rubber 89 left in the inserted state in the tube shaped flow path part 85.

Figure 7A:
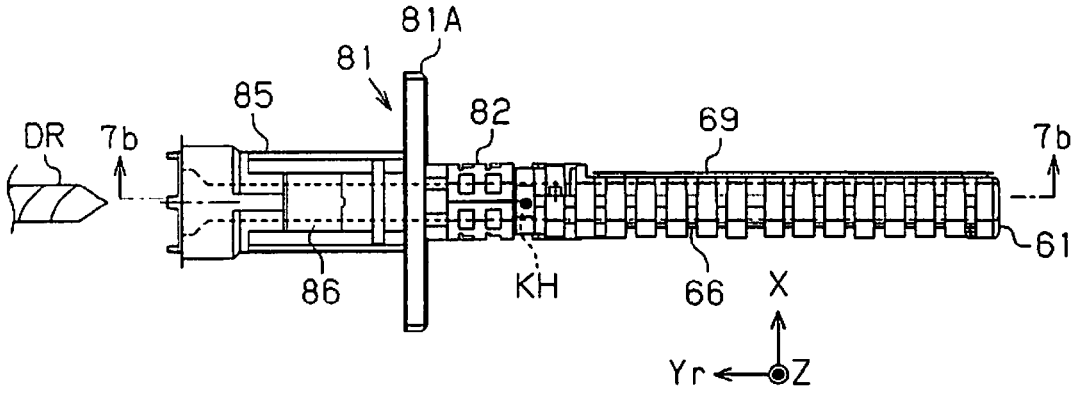
FIG. 7A is a side view of a supply member for which a through hole is formed in the supply port.
Figure 7B:
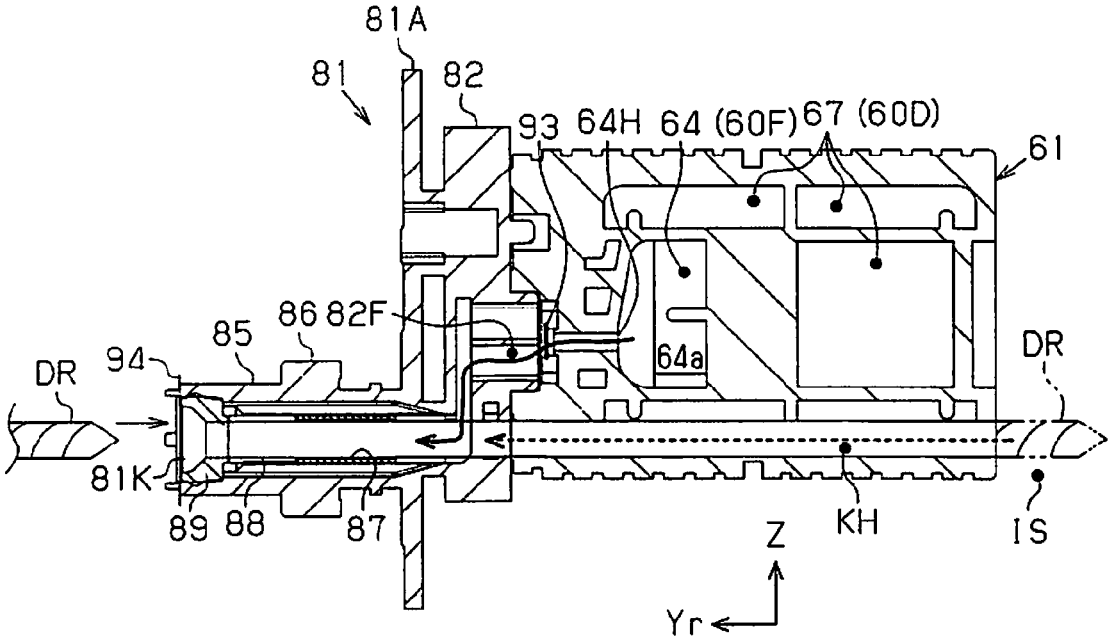
FIG. 7B is an arrow cross section view of line 7*b*-7*b* in FIG. 7A.

As shown in FIGS. 7A and 7B, as an example, the through hole KH is formed using a rotating drill with this embodiment. Specifically, in a state with the center of the supply port 81K roughly matching the shaft center of the drill DR, while the drill DR is being rotated along the axis line direction of the tube shaped flow path part 85, it is inserted from the supply port 81K into the supply member 81. As a result, by the drill DR cutting and rotating to advance through the supply member 81 and the connecting member 61 attached to the supply member 81, the linear through hole KH which is in direct communication with the supply port 81K and the ink chamber IS is formed. As shown by the dotted line arrow in FIG. 7B, this through hole KH merges with the supply flow path 82F in which ink flows via the ink outflow port 6411 from the filter chamber 60F, and becomes the flow path of ink reaching the supply port 81K. Specifically, in contrast to the supply flow path 82F, the through hole KH becomes the detour flow path flowing to the supply port 81K without the ink inside the ink chamber IS passing through the filter 66.

This through hole KH formed on the connecting member 61 is arranged at a position for which the filter 66 does not overlap with the supply port 81K seen from the axis line direction of the tube shaped flow path part 85. Specifically, the through hole KH is formed at a position spatially separated that does not interfere with the filter 66 of the connecting member 61. Also, with this embodiment, the through hole KH formed on the connecting member 61 is formed at a position spatially separated that also does not interfere with the filter chamber 60F.

Furthermore, the through hole KH is formed on the interior separated from the outer surface of the connecting member 61 which has a high probability of contact by the pack members 92A and 92B with the ink pack 80 for which ink has decreased. Therefore, the occurrence of damage to the pack members 92A and 92B by the drill DR when forming the through hole KH is suppressed.

The through hole KH can interfere with the de-aerating chamber 60D and cause direct communication by the ink chamber IS with the de-aerating chamber 60D. In this case, though this leads to the loss of the negative pressure state of the de-aerating chamber 60D, normally, by suction of gas (air bubbles) contained in the ink housed in the ink pack 80 before the recycling process, since the de-aerating chamber 60D has the negative pressure state already almost all consumed, communication between the de-aerating chamber 60D and the through hole KH is allowed in practical terms.

Subsequently, at step S14 in FIG. 6, the process of injecting ink into the supply port 81K is performed (injection step).

Figure 8:
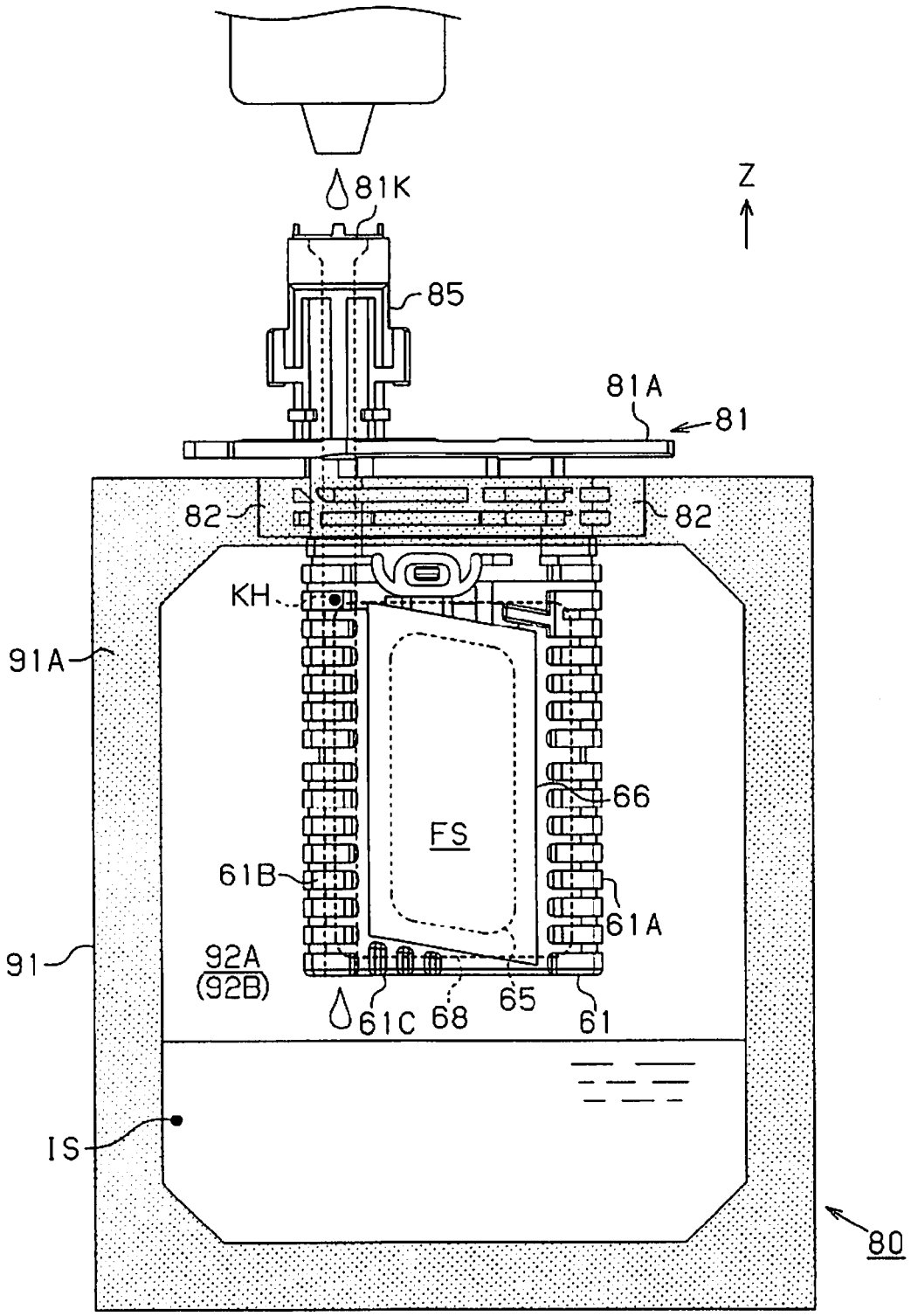
FIG. 8 is an explanatory drawing of a state with ink injected inside a pack body using the formed through hole.

As shown in FIG. 8, with the process here, the collector has the ink pack 80 in an orientation for which the opening of the supply port 81K is at the antigravity direction side of the perpendicular direction. In this orientation, ink from the through hole KH is injected inside the ink chamber IS. With this injection process, the ink flows more easily along the linear through hole KM extending straight to the gravity direction side than flowing in the supply flow path 82F. Therefore, it is possible to inject ink into the ink chamber IS inside the pack body 91 smoothly via the through hole KH.

Though omitted from the illustration in FIG. 8, when injecting ink into the supply port 81K, it is also possible to perform the injection work with insertion of a tool that makes ink injection easier such as a funnel, for example. Also, when injecting the ink, it is possible to pressurize the ink.

Next, at step S15 in FIG. 6, the process of sealing the supply port 81K is performed. Here, after the ink is injected, the supply port 81K is again sealed by the supply port film 94. With this seal, the ink injected inside the ink pack 80 is made not to leak out from the supply port 81K.

When doing the through hole KH forming process at step S13, it is also possible to remove the supply port spring 87, the supply port spring seat 88, and the supply port sealing rubber 89 inserted in the supply port 81K in advance. By doing this, the formation of the through hole KH is easier. Also, after the ink injection process at step S14, before the sealing process of the supply port 81K at step S15, it is also possible to again insert in the supply port 81K the removed supply port spring 87, the supply port spring seat 88, and the supply port sealing rubber 89, or possible to insert the new supply port spring 87, the supply port spring seat 88, and the supply port sealing rubber 89.

Next, at step S16, the process of attaching the ink pack 80 to the second case member 72 is performed. Here, after the user inserts the tube shaped flow path part 85 of the ink pack 80 in which ink has been injected again into a hole provided in the concave shaped part 75 of the second case member 72, the supply member 81 is rotated, and the tube shaped flow path part 85 is fixed and attached at the concave shaped part 75.

Subsequently, at step S17, the process of attaching the second case member 72 to the first case member 71 is performed while inserting the ink pack 80 inside the first case member 71. Here, the collector inserts the ink pack 80 from the opening area 71S into the first case member 71, and moves the second case member 72 by sliding to approach the first case member 71. By this sliding movement, by the projecting part 71F of the first case member 71 being fit into the hole part 72H of the second case member 72, the second case member 72 is attached to the first case member 71, and recycling processing of the ink cartridge 70 ends.

With the embodiment described above, it is possible to obtain the following effects.

(1) Even when the filter 66 is in a state clogged by foreign matter, the ink cartridge 70 can be recycled so as to be able to smoothly flow ink from the pack body 91 via the detour flow path to the supply port 81K.

(2) The detour flow path is formed by providing the through hole KH in the supply member 81, so it is possible to easily form the detour flow path that flows the ink inside the pack body 91 to the supply port 81K.

(3) With an easy method of forming the through hole KH in straight line form in the direction along the tube shaped flow path part 85 from the supply port 81K, it is possible to form the detour flow path while suppressing damage to the filter 66.

(4) Ink is injected into the pack body 91 from the supply port 81K via the through hole KH, so it is possible to smoothly flow and inject ink into the pack body 91 from the supply port 81K using the detour flow path that does not go via the filter 66, without forming a separate ink injection port on a separate pack body 91.

The embodiment noted above can also be modified to other embodiments such as those noted below.

With the embodiment noted above, the detour flow path can also be formed by other than the through hole KH. For example, at step S13 in FIG. 6, it is also possible to form as the detour flow path a groove part that pierces through the supply port 81K and the ink pack 80 rather than the through hole KH.

Figure 9B:
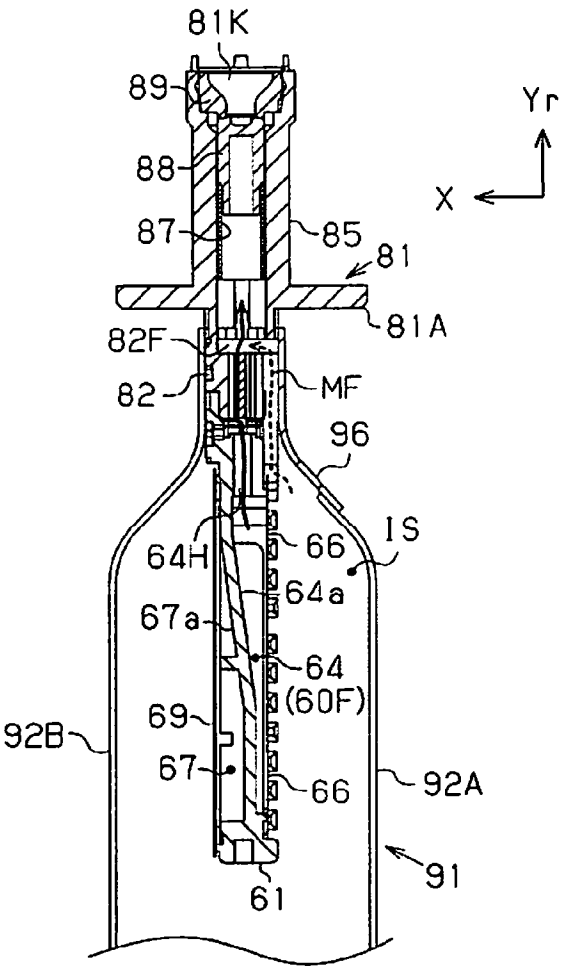
FIGS. 9A and 9B illustrate a modification example, where
Figure 9A:
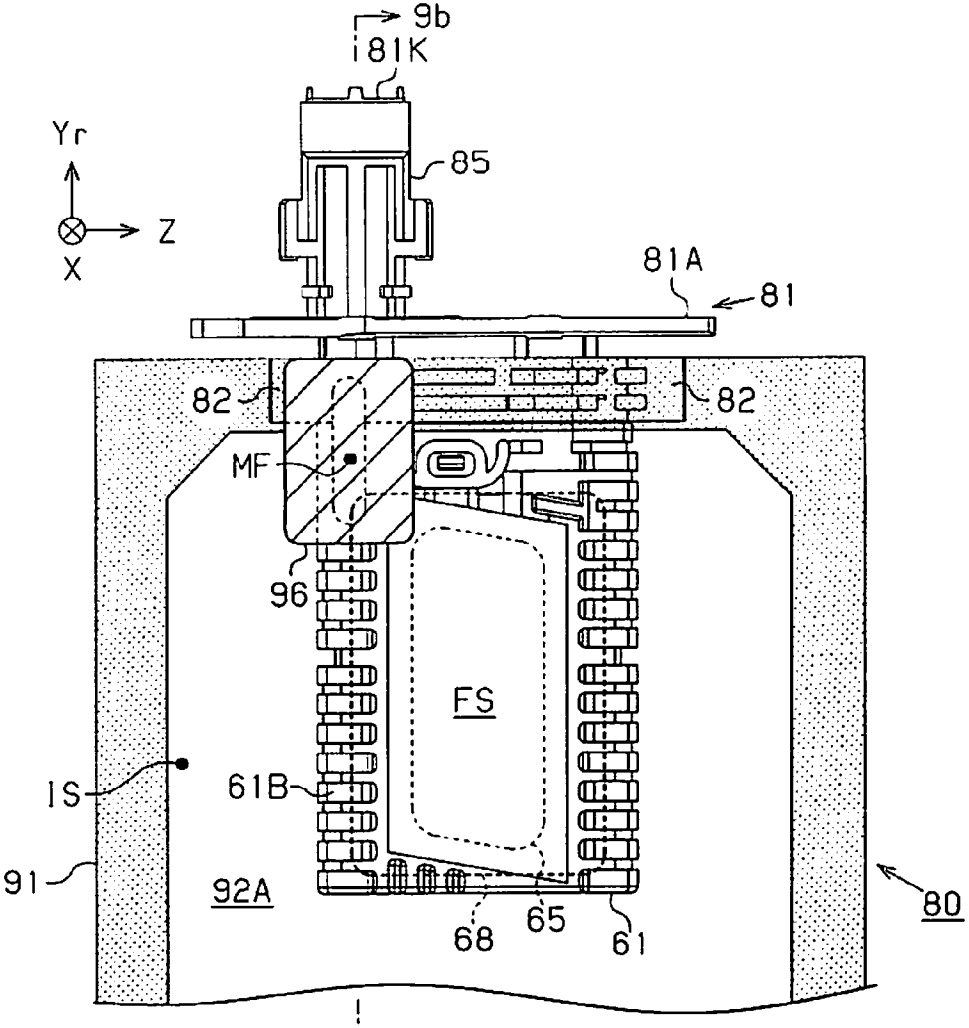

As shown as an example in FIGS. 9A and 9B, with this modification example, at step S13 in FIG. 6, a process is performed of forming on the ink pack 80 a groove part MF of a designated length reaching from the junction part 82 of the supply member 81 to the connecting member 61 using an end mill or the like, for example. This groove part MF is formed at a depth that communicates with the supply flow path 82F formed inside the supply member 81. Then, after the groove part MF is formed, the process of joining a repair sheet 96 to the pack member 92A using an adhesive agent or the like so as to close the opening of the pack member 82A damaged by formation of the groove part MF is done.

As a result of this process, as shown by the dotted line arrow in FIG. 9B, the groove part MF has the detour flow path formed for which ink flows to the supply port 81K from the ink chamber IS inside the pack body 91, without passing through the filter 66, separate from the flow of ink via the supply flow path 82F shown by the solid arrow.

Alternatively, as another modification example of the detour flow path, though not illustrated here, it is also possible to use a constitution for which, using a tube in which ink can flow, for example, one end of that is inserted inside the tube shaped flow path part 85 to be in communication with the supply port 81K, and the other end is inserted inside the pack body 91 to be in communication with the ink chamber IS. By doing this, the tube functions as the detour flow path that flows ink between the ink chamber IS and the supply port 81K without going via the filter 66.

With the embodiment noted above, it is not absolutely necessary to form the through hole KH in a straight line. For example, it can also be a curved line, or can be a bent line. In short, as long as it is possible to form it in a state for which the supply port 81K and the pack body 91 interior are in communication without going via the filter 66, the through hole can be formed in a form according to the processing means or processing method.

With the embodiment noted above, at the injection step of step S14 shown in FIG. 6, it is not absolutely necessary for the collector to inject ink from the supply port 81K of the ink pack 80 via the through hole KH inside the pack body 91. For example, it is also possible to provide a separate opening on the pack body 91, and to inject ink from this opening inside the pack body 91. Of course, after injection, sealing is done so that ink from the opening does not leak out.

With the embodiment noted above, it is not absolutely necessary to form the de-aerating chamber 60D. When there is a low probability of gas being contained in the ink, the de-aerating chamber 60D is not necessary. In this case, for example, it is not necessary to provide the second recess area 67 in the connecting member 61. Alternatively, the de-aerating chamber 60D can also have a constitution such that even if the second recess area 67 is provided, the film 69 is not adhered at the second opening 68.

With the ink cartridge 70 of the embodiment noted above, it is not absolutely necessary to equip the electrical connection part 30. Also, the circuit substrate as the electrical connection part 30 does not absolutely have to be inclined in the insertion direction Yr to the mounting unit 20. For example, it is also possible to use the direction orthogonal to the insertion direction Yr.

With the embodiment noted above, the mounting unit 20 can also have a constitution equipped on the outside of the case 11*a* of the printer 11. When supplying ink to the liquid spray head 18 on the interior of the case 11*a* from the mounting unit 20 provided on the outside of the case 11*a*, it is necessary to lead the ink supply tube TB for supplying ink from the outside of the case 11*a* to the inside. Thus, in this case, it is preferable to provide a hole or notch in the case 11*a* in which the ink supply tube TB can be inserted. Alternatively, it is also possible to lead the ink supply tube TB through the gap provided in the case 11*a* from outside to inside the case 11*a*. By doing this, it is possible to easily perform supplying of ink to the liquid spray head 18 using the ink flow path of the ink supply tube TB.

The liquid spray head 18 is not limited to being a so-called serial head type that sprays ink by moving back and forth together with the carriage 16 in the direction crossing the conveyance direction of the paper P. Specifically, it has an overall shape for which the length size corresponds to the width size of the paper P, and in a state with the lengthwise direction fixed and arranged to go along the width direction that crosses the conveyance direction Y of the paper P, it is also possible to have an item of a so-called line head type that sprays liquid toward the medium from a plurality of nozzles provided so as to extend across roughly the entirety in the lengthwise direction.

With the embodiment noted above, the printer 11 can also be a liquid consuming device that sprays or discharges liquid other than ink. The state of the liquid discharged as tiny droplets from the liquid consuming device includes granular shapes, tear shapes, and threadlike shapes with a tail. What is referred to here as a liquid is acceptable as long as it is a material that can be sprayed by the liquid consuming device. For example, a substance when it is in a liquid state such as liquid state materials of high or low viscosity, as well as fluid bodies such as sol, gel water, other inorganic solvents, organic solvents, solutions, liquid resin, liquid metal (metal melt), and the like are included. Also, this is not limited to liquids as one physical property state, but items for which particles of functional materials consisting of a solid such as a pigment, metal particles or the like are dissolved, dispersed, or blended in a solvent and the like are also included. Representative examples of liquid or liquid body printing materials include the kind of ink like that described with the embodiments noted above, liquid crystal and the like. Here, ink includes various types of liquid body compositions such as typical water based inks and oil based inks as well as gel inks, hot melt inks and the like. As a specific example of a liquid consuming device, for example, there are liquid consuming devices which spray liquid including materials such as electrode materials or coloring materials or the like in a dispersed or dissolved form used in manufacturing items such as liquid crystal displays, EL (electro luminescence) displays, surface light emitting displays, color filters and the like. It is also possible to be a liquid consuming device for spraying bioorganic material used for biochip manufacturing, a liquid consuming device for spraying a liquid that will be a sample used for a precision pipette, a textile printing device, a micro dispenser or the like. Furthermore, it is also possible to use a liquid consuming device for spraying lubricating oil with a pinpoint on precision machines such as watches, cameras or the like, or a liquid consuming device for spraying a transparent resin liquid such a ultraviolet curing resin or the like for forming a miniature hemispheric lens (optical lens) used for optical communication elements or the like on a substrate. It can also be a liquid consuming device for spraying an acid or alkaline or the like etching fluid for etching a substrate or the like.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only a selected embodiment has been chosen to illustrate the present invention, it will be apparent to those skilled in the art from this disclosure that various changes and modifications can be made herein without departing from the scope of the invention as defined in the appended claims. Furthermore, the foregoing descriptions of the embodiment according to the present invention are provided for illustration only, and not for the purpose of limiting the invention as defined by the appended claims and their equivalents.

What is claimed is:

1. A liquid housing container recycling method for a liquid housing container with a liquid housing body that includes a liquid housing unit that is configured to house liquid, a supply member with a supply port that is configured to be connected to a liquid supply tube of a liquid consuming device, and a filter through which the liquid is configured to pass, with the liquid inside the liquid housing unit being supplied to the liquid consuming device by, after passing through the filter, flowing to the supply port along a supply flow path of the supply member, the liquid housing container recycling method comprising:

forming a detour flow path in the liquid housing body such that the liquid inside the liquid housing unit flows to the supply port without passing through the filter in the detour flow path, the detour flow path being a through hole that is formed in the supply member and pierces between the supply port and inside the liquid housing unit, the supply port being arranged at a flow path end of a tube shaped flow path part with a straight line forming a portion of the supply flow path as an axis line, the through hole formed on the supply member being a hole extending from the supply port in a straight line along the axis line direction of the tube shaped flow path part; and injecting the liquid inside the liquid housing unit.

2. The liquid housing container recycling method according to claim 1, wherein the filter is arranged at a position that does not overlap the supply port as viewed from the axis line direction of the tube shaped flow path part.

3. The liquid housing container recycling method according to claim 1, wherein the injecting of the liquid includes injecting the liquid from the supply port to the liquid housing unit via the detour flow path that has been formed.

4. A liquid housing container recycled by the liquid housing container recycling method according to claim 1.

* * * * *